US012653226B2

(12) United States Patent
Zhu

(10) Patent No.: US 12,653,226 B2
(45) Date of Patent: Jun. 16, 2026

(54) CIGARETTE DEVICE

(71) Applicant: AGAG TECH INC, Dover, DE (US)

(72) Inventor: Yuanzhuang Zhu, Guangdong (CN)

(73) Assignee: AGAG TECH INC, Dover, DE (US)

( * ) Notice: Subject to any disclaimer, the term of this patent is extended or adjusted under 35 U.S.C. 154(b) by 0 days.

(21) Appl. No.: 18/677,772

(22) Filed: May 29, 2024

(65) Prior Publication Data

US 2025/0295162 A1 Sep. 25, 2025

(30) Foreign Application Priority Data

Mar. 20, 2024 (CN) ..... 202420555593.7

(51) Int. Cl.

| | |
|---|---|
| ***A24D 1/04*** | (2006.01) |
| ***A24D 1/00*** | (2020.01) |
| ***A24D 3/18*** | (2006.01) |

(52) U.S. Cl.

CPC ..... *A24D 1/042* (2013.01); *A24D 1/002* (2013.01); *A24D 3/18* (2013.01)

(58) Field of Classification Search

CPC ..... A24D 1/042; A24D 1/045; A24D 3/18; A24D 3/0245

USPC ..... 131/360, 361, 363

See application file for complete search history.

(56) References Cited

U.S. PATENT DOCUMENTS 2,001,709 A * 5/1935 Davidson ..... A24D 3/0245 156/227

2007/0235050 A1* 10/2007 Li ..... A24D 3/043 131/338

FOREIGN PATENT DOCUMENTS

CN 2237947 Y * 10/1996 ..... A24D 3/00

OTHER PUBLICATIONS

CN2237947Y (Machine Translation) [online], [retrieved on Oct. 15, 2024], retrieved from ESPACENET (https://worldwide.espacenet.com/) (Year: 1996).*

* cited by examiner

*Primary Examiner* — Philip Y Louie
*Assistant Examiner* — Yana B Krinker
(74) *Attorney, Agent, or Firm* — JCIPRNET

(57) ABSTRACT

A cigarette device, which includes a cigarette pipe, a first isolator and a mouthpiece arranged in sequence. The cigarette pipe is rolled to form a hollow accommodating space inside, and the accommodating space is used for accommodating the smoking substance. The mouthpiece is provided with a first diversion channel. The first isolator separates the mouthpiece from the smoking substance, and the first isolator is provided with a second diversion channel. The second diversion channel connects with the first diversion channel and the accommodating space of the cigarette pipe respectively. The cigarette device adds the first isolator between the mouthpiece and the cigarette pipe, so that the first isolator can isolate the smoking substance such as tobacco from the mouthpiece. it can effectively isolate the heat generated by the combustion of the tobacco at the cigarette pipe.

8 Claims, 8 Drawing Sheets

CIGARETTE DEVICE

CROSS-REFERENCE TO RELATED APPLICATION

This application claims the priority benefit of China application serial no. 202420555593.7, filed on Mar. 20, 2024. The entirety of each of the above-mentioned patent applications is hereby incorporated by reference herein and made a part of this specification.

BACKGROUND

Technical Field

The present disclosure belongs to the technical field of smoking sets, and in particular relates to a cigarette device.

Description of Related Art

The hand cigarette is a cigarette which is rolled by hand, and the structure of which generally includes a mouthpiece and a cigarette pipe made of rolling paper. A smoking substance such as tobacco can be put in and smoked through the mouthpiece after being ignited, so the hand cigarette is strong in self-operability and can be rolled and smoked according to needs. However, the structure of the mouthpiece and the cigarette pipe made of the rolling paper will cause the tobacco debris to be sucked into the mouth without being burned. Additionally, the tail end of the mouthpiece's folding paper is prone to igniting, resulting in an unpleasant smoking experience. The wide-open air passage can also lead to high temperature that can burn the mouth during smoking. Furthermore, uneven airflow can result in inconsistent smoke volume with each puff, leading to a poor experience.

SUMMARY

An object of the present disclosure is to provide a cigarette device that can thermally isolate the smoke generated from the smoking substance inside the cigarette pipe, such as tobacco, and evenly direct the airflow towards the mouthpiece.

The technical solutions to achieve the above objective include the following.

A first aspect of the present disclosure provides a cigarette device including a cigarette pipe, a first isolator and a mouthpiece arranged in sequence;

- the cigarette pipe is rolled to form a hollow accommodating space inside, and the accommodating space is used for accommodating the smoking substance;
- the mouthpiece is provided with a first diversion channel;
- the first isolator separates the mouthpiece from the smoking substance, and the first isolator is provided with a second diversion channel, the second diversion channel communicates with the first diversion channel and the accommodating space of the cigarette pipe.

In some embodiments, the mouthpiece is provided with a peripheral edge near an end of the cigarette pipe, the peripheral edge forms a receiving groove, the first isolator is partially or wholly accommodated in the receiving groove, and the cigarette pipe sleeves a portion or all of an outer peripheral wall of the mouthpiece.

In some embodiments, the mouthpiece includes a rolling body that is flexible, the rolling body is rolled and/or folded to form a multi-layer roll-shaped mouthpiece, a spacing space exists between at least two adjacent layers in the mouthpiece that is roll-shaped, and the spacing space forms the first diversion channel.

In some embodiments, the rolling body includes a first rolling body and a second rolling body connected with the first rolling body, after the rolling body is rolled and/or folded, the second rolling body encloses the periphery of a roll-shaped layer of the first rolling body and partially protrudes from the roll-shaped layer of the first rolling body, and the portion of the second rolling body protruding from the roll-shaped layer of the first rolling body forms the peripheral edge.

In some embodiments, the first rolling body and the second rolling body cooperate to form an L-shaped rolling body when the first rolling body and the second rolling body are in an unfolded state.

In some embodiments, wherein the longitudinal cross-section of the mouthpiece has a roll-shaped structure with an inner layer in an M-shape and an outer layer in a spiral shape.

In some embodiments, the longitudinal cross-section of the mouthpiece has a spiral roll-shaped structure.

In some embodiments, the second diversion channel includes a plurality of air flow holes formed in the axial direction of the first isolator, the first isolator is inwardly recessed at one end adjacent to the cigarette pipe to form a groove communicating with the air flow holes, and the groove extends outward in its own radial direction to form radial air passages.

In some embodiments, the first isolator has a cylindrical ceramic body structure.

In some embodiments, a peripheral wall of the first isolator protrudes outwardly to form a convex arc structure, and the radial length of the first isolator adjacent to the cigarette pipe is greater than the radial length of the first isolator adjacent to the mouthpiece.

In some embodiments, a flavoring member is disposed in the first isolator, and a flavoring material is provided in the flavoring member.

In some embodiments, the cigarette device further includes a second isolator, the second isolator having an adsorbing property, the second isolator being disposed between the mouthpiece and the first isolator.

In some embodiments, a flavoring member is disposed in the second isolator, and a flavoring material is provided in the flavoring member.

The technical solutions provided by the present disclosure have the following advantages and effects:

The cigarette device adds the first isolator between the mouthpiece and the cigarette pipe, so that the first isolator can isolate the smoking substance such as tobacco and the mouthpiece. On the one hand, it can effectively isolate the heat generated by the combustion of the tobacco at the cigarette pipe, thereby reducing the heat conducted to the mouthpiece and effectively preventing the mouth from getting burned. On the other hand, it can effectively prevent direct suction of unburned tobacco debris during the smoking process through the mouthpiece, and can make the tobacco fully burn, and the first isolator is provided with a second flow guiding passage which can communicate the first flow guiding passage and the accommodating space of the cigarette pipe, ensuring that smoke can flow smoothly from the cigarette pipe to the mouthpiece for smoking. The extended airflow channel can also control the airflow of the smoke, enabling it to flow evenly, thus effectively improving the smoking experience.

DESCRIPTION OF THE EMBODIMENTS

Figure 1:
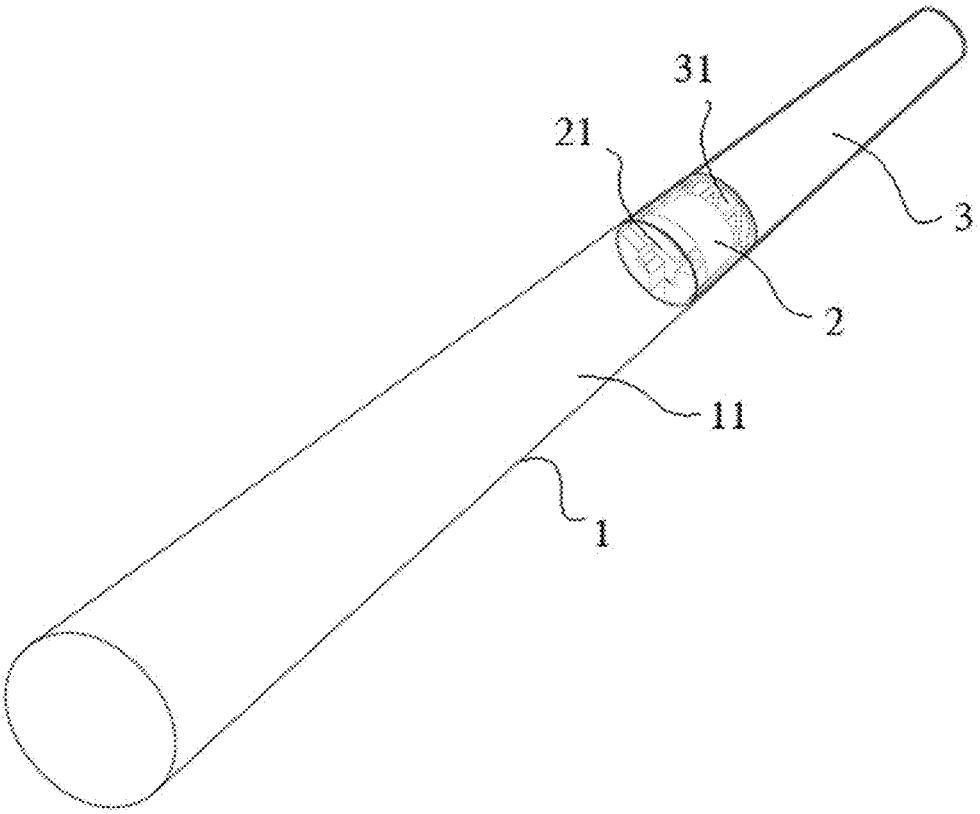
FIG. 1 is a schematic structural diagram of a cigarette device according to an embodiment of the present disclosure.

In order to facilitate an understanding of the disclosure, certain exemplary embodiments of the present disclosure are described herein and are illustrated in the accompanying figures.

Unless specifically stated or otherwise defined, "first, second . . . " as used herein is merely employed to distinguish names and does not denote a specific quantity or order.

Unless specifically stated or otherwise defined, the term "and/or" as used herein includes any and all combinations of one or more of the associated listed items thereof.

It should be noted that the terms "fixed to" and "connected with" as used herein may be directly fixed or connected with an element or indirectly fixed or connected with an element.

It should be noted that the cigarette device can be loaded with a smoking substance to be burned to form smoke for smoking, wherein the smoking substance can be changed according to the individual's smoking habits, and can be a variety of materials capable of performing smoking, for example, tobacco or the like, without being particularly limited herein.

The embodiments of the present disclosure provide a cigarette device, as shown in FIGS. 1 to 10, including a cigarette pipe 1, a first isolator 2 and a mouthpiece 3 arranged in sequence.

The cigarette pipe 1 is rolled to form a hollow accommodating space 11 inside, and the accommodating space 11 is used for accommodating the smoking substance, such as tobacco, and the smoking substance is replaced with tobacco for convenience of description below, but it is not intended that the smoking substance be limited to only tobacco, and other materials that can be combusted to form smoke for smoking can be used. Wherein, the tobacco may be filled by hand, or assisted by a filling tool, and is not particularly limited herein. In addition, it should be noted that the cigarette pipe 1 is made of a combustible material, such as cigarette paper made of natural fibers like hemp pulp or blended wood pulp, or a filler material such as calcium carbonate, which is generally white in color or other colors such as brown. The cigarette pipe 1 cannot have a burning smell, and can be ignited for smoking after being filled with tobacco. The original state of the cigarette pipe 1 may be of a rolled tubular structure having the accommodating space 11, or the original state of the cigarette pipe 1 may be an unfolded state, which is then rolled and bonded to form the accommodating space 11 when smoking is needed, and there is no special limitation herein.

The mouthpiece 3 is provided with a first diversion channel 31; wherein, the original state of the mouthpiece 3 may be a rolled mouthpiece 3 with the first flow diversion channel 31, or the original state of the mouthpiece 3 may be an unfolded state, and the mouthpiece 3 may be rolled to form the mouthpiece 3 with the first flow diversion channel 31 when smoking is needed. There is no special limitation herein.

The first isolator 2 separates the mouthpiece 3 and the tobacco, and the first isolator 2 has a second diversion channel 21 thereon, which connects the first diversion channel 31 and the accommodating space 11, respectively.

Wherein, the mouthpiece 3, the first isolator 2 and the cigarette pipe 1 can be assembled in a factory state, i.e., a complete structural state, and the tobacco is filled into the accommodating space 11 of the cigarette pipe 1 and encapsulated when smoking is needed; alternatively, the mouthpiece 3, the first isolator 2, and the cigarette pipe 1 may be assembled in the factory state, with the tobacco filled into the accommodating space 11 of the cigarette pipe 1 and encapsulated. Alternatively, the mouthpiece 3, the first isolator 2 and the cigarette pipe 1 of the cigarette device are separated and unfolded in the factory state, i.e., when smoking is needed, the three of the mouthpiece 3, the first isolator 2 and the cigarette pipe 1 are rolled and assembled, and the tobacco is filled into the accommodating space 11 of the cigarette pipe 1 and encapsulated, and there is no special limitation herein.

Wherein, the cigarette device adds the first isolator 2 between the mouthpiece 3 and the cigarette pipe 1, so that the first isolator 2 can isolate the tobacco and the mouthpiece 3. On the one hand, it can effectively isolate the heat generated by the combustion of the tobacco at the cigarette pipe 1, thereby reducing the heat conducted to the mouthpiece 3 and effectively preventing the mouth from getting burned. On the other hand, it can effectively prevent direct suction of unburned tobacco debris during the smoking process through the mouthpiece 3, and can make the tobacco fully burn, and the first isolator 2 is provided with a second diversion channel 21 which can connect the first diversion channel 31 and the accommodating space 11 of the cigarette pipe 1, ensuring that smoke can flow smoothly from the cigarette pipe 1 to the mouthpiece 3 for smoking. The extended airflow channel can also control the airflow of the smoke and enable it to flow evenly, thus effectively improving the smoking experience.

Figure 8:
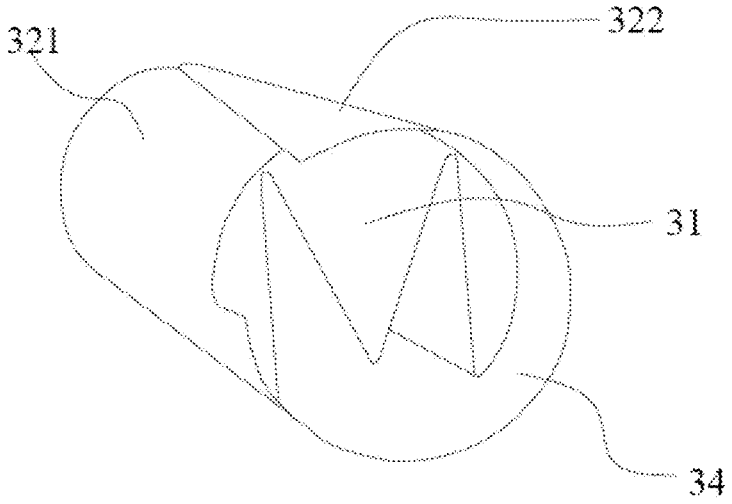
FIG. 8 is a schematic structural diagram of a semi-rolled state of the mouthpiece in a rolling mode thereof.

In some embodiments, as shown in FIG. 1 and FIG. 8, the mouthpiece 3 is provided with a peripheral edge 34 near one end of the cigarette pipe 1, the peripheral edge 34 forms a receiving groove, the first isolator 2 is partially or wholly accommodated in the receiving groove, and the cigarette pipe 1 sleeves a portion or all of an outer peripheral wall of the mouthpiece 3. Wherein, the peripheral edge 34 is provided on the mouthpiece 3, the position of the first isolator 2 can be limited and fixed, and quick assembly can be facilitated, wherein, the first isolator 2 can be a receiving groove in which only a portion of one end of the first isolator 2 is accommodated in the peripheral edge 34, or the first isolator 2 can be wholly accommodated in the peripheral edge 34 and the end surface of the first isolator 2 is flush with the edge of the peripheral edge 34. At least a portion of the outer peripheral wall of the mouthpiece 3 is sleeved with the cigarette pipe 1, and particularly, all of the outer peripheral wall of the mouthpiece 3 is sleeved with the cigarette pipe 1, or a portion of the outer peripheral wall of the mouthpiece 3 is sleeved with the cigarette pipe 1, and the mouthpiece 3 and the cigarette pipe 1 are closely fitted, so that the cigarette pipe 1 and the mouthpiece 3 are fixed to each other to ensure a smooth transition between them, and the smoke is effectively prevented from flowing out of the gap where the mouthpiece 3 and the cigarette pipe 1 are connected.

Figure 3:
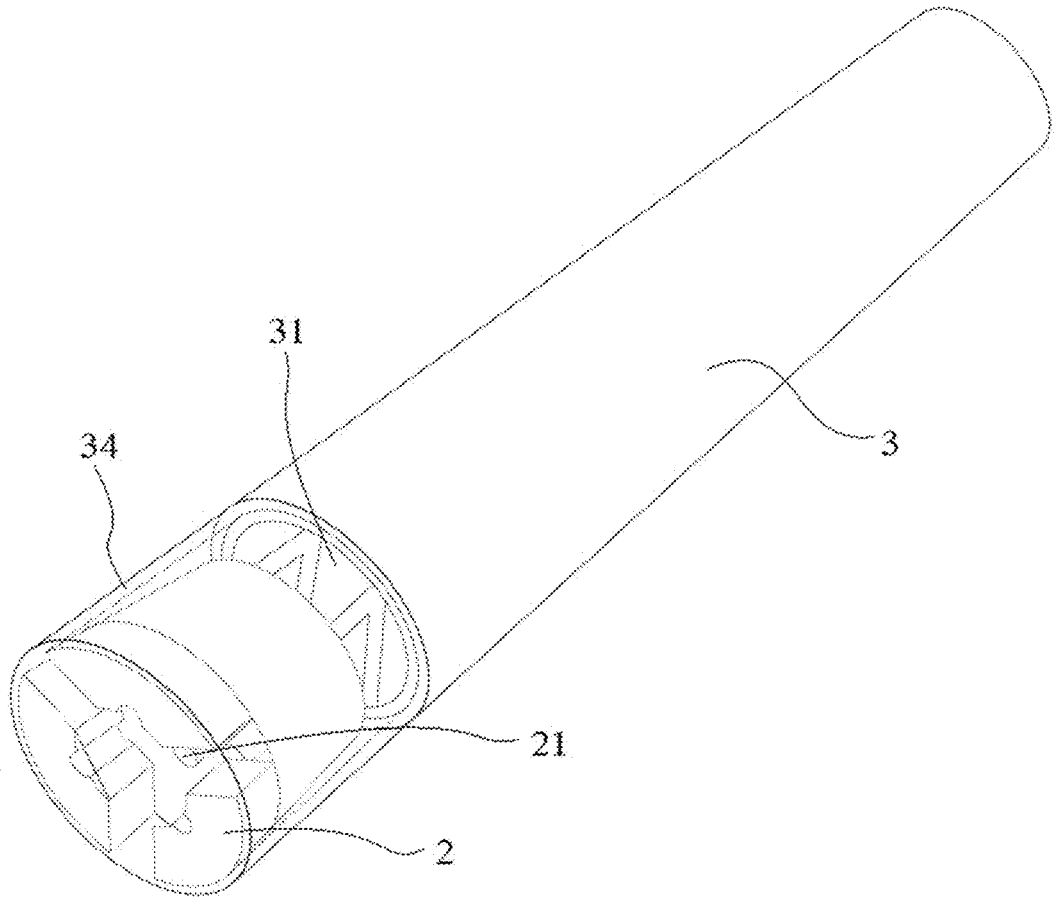
FIG. 3 is a schematic diagram of a partial structure of the cigarette device of FIG. 1.
Figure 6:
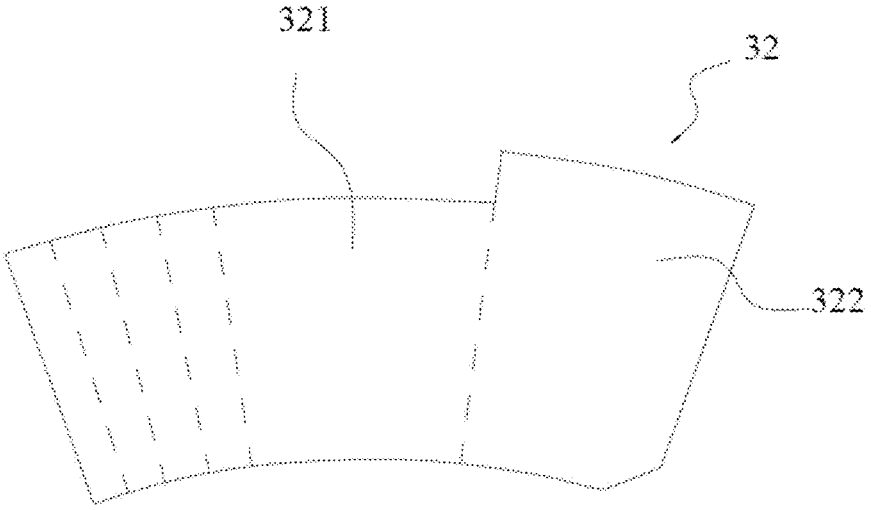
FIG. 6 is a schematic structural diagram of a mouthpiece in an unfolded state according to an embodiment of the present disclosure.

In some embodiments, as shown in FIGS. 3, 6 and 8, the mouthpiece 3 includes a rolling body 32 with a flexible property, wherein the rolling body 32 may be a rolled paper material with certain stiffness, such as tipping paper or the like, which is not particularly limited here. The rolling body 32 is rolled and/or folded to form a multi-layer roll-shaped mouthpiece, a spacing space exists between at least two adjacent layers in the roll-shaped mouthpiece, and the spacing space forms the first diversion channel 31. Wherein, the factory state of the mouthpiece 3 may be a rolled mouthpiece which has been rolled and shaped, it is ready to be assembled directly when smoking is needed, alternatively, the factory state of the mouthpiece 3 may be an unshaped unfolded state, when smoking is needed, the roll-shaped mouthpiece is formed by rolling. There is an interval space between at least two adjacent layers in the roll-shaped mouthpiece for airflow diversion, it is possible to make the smoke of the burnt tobacco inside the cigarette pipe 1 pass smoothly through the interval space between at least two adjacent layers of the mouthpiece 3 into the mouth for smoking, and the structure of the multi-layer body is capable of improving the structural strength on the one hand, and dispersing the smoke airflow on the other hand, so as to improve the smoking mouth feeling.

In some embodiments, as shown in FIGS. 3, 6 and 8, the rolling body 32 includes a first rolling body 321 and a second rolling body 322 connected with the first rolling body 321, after the rolling body 32 is rolled and/or folded, the second rolling body 322 encloses the periphery of a roll-shaped layer of the first rolling body 321 and partially protrudes from the roll-shaped layer of the first rolling body 321, and the portion of the second rolling body 322 protruding from the roll-shaped layer of the first rolling body 321 forms the peripheral edge 34. Wherein, the first rolling body 321 and the second rolling body 322 may be an integrally formed structure or a separately connected structure, it is preferably an integrally formed structure, through shape design and rolling in a specific direction, the roll-shaped layer of the second rolling body 322 after being rolled is located at the periphery of the roll-shaped layer of the first rolling body 321 and at least partially protrudes from the periphery of the roll-shaped layer of the first rolling body 321 to form a peripheral edge 34 structure capable of fixing the first isolator 2. Specifically, in the present embodiment, when the first rolling body 321 and the second rolling body 322 are in an unfolded state, the first rolling body 321 and the second rolling body 322 cooperate to form an L-shaped rolling body. By providing the L-shaped rolling body, the peripheral edge 34 structure can be quickly formed during the rolling process, and the assembly is more convenient.

Figure 9:
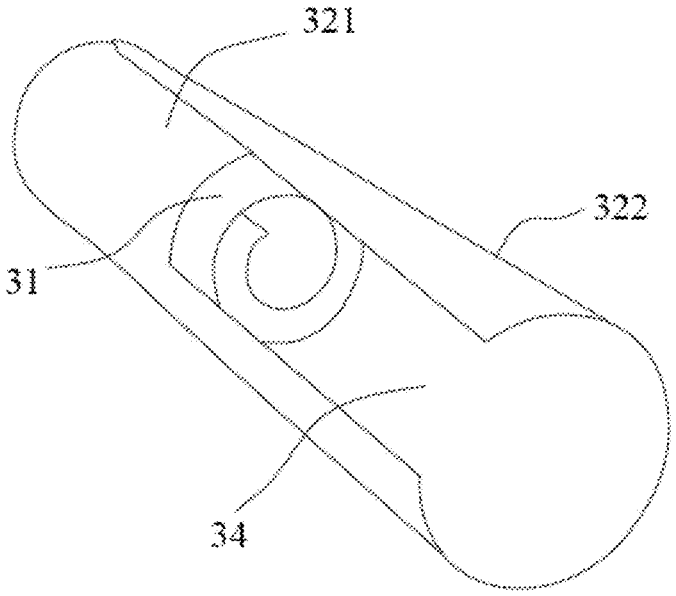
FIG. 9 is a schematic structural diagram of a semi-rolled state of the mouthpiece in another rolling mode thereof.

In some embodiments, as shown in FIG. 8, the longitudinal cross-section of the mouthpiece 3 has a roll-shaped structure with an inner layer in an M-shape and an outer layer in a spiral shape. Wherein, the roll-shaped structure of the mouthpiece 3 can be folded to form with an inner layer in an M-shape and an outer layer in a spiral shape through folding the preset creases on the rolling body 32, and the mouthpiece 3 of this structure has a better airflow diversion effect, which can better improve the smoking experience. Alternatively, in other embodiments, as shown in FIG. 9, the longitudinal cross-section of the mouthpiece 3 has a spiral roll-shaped structure, wherein, the spiral roll-shaped structure facilitates the rolling operation and also provides a better smoking experience.

Figure 4:
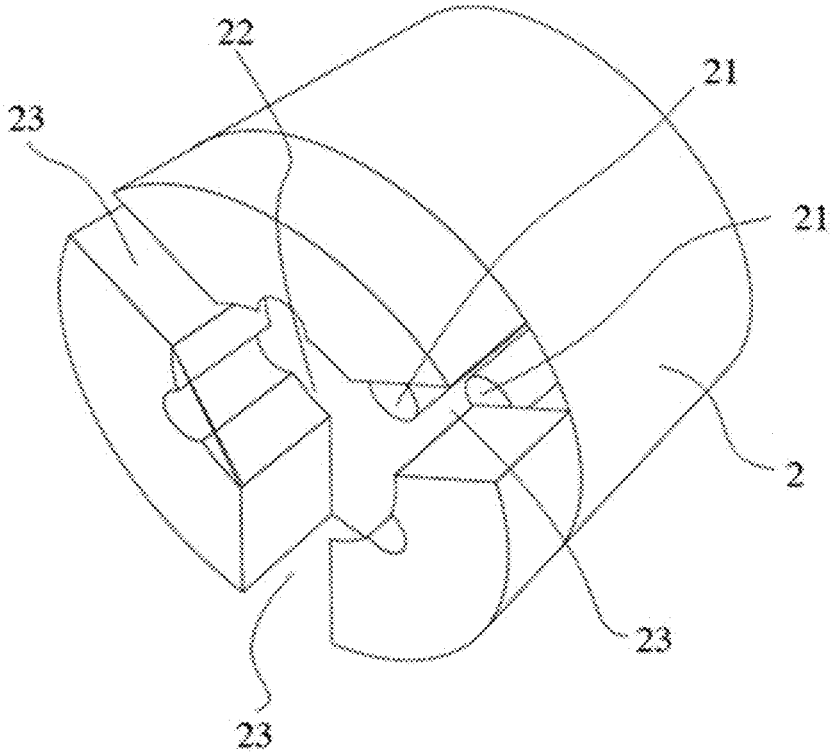
FIG. 4 is a schematic structural diagram of a first isolator according to an embodiment of the present disclosure.

In some embodiments, as shown in FIG. 4, the second diversion channel 21 includes a plurality of air flow holes formed in the axial direction of the first isolator 2, wherein the plurality of air flow holes can ensure the unobstructed air flow paths, so that the smoking experience is greatly improved; the first isolator 2 is inwardly recessed at one end adjacent to the cigarette pipe to form a groove 22 connected with the air flow holes, and the groove 22 extends outward in its own radial direction to form radial air passages 23. The radial air passages 23 and groove 22 are configured to effectively prevent the tobacco from blocking the air flow holes, thereby ensuring the unobstructed side and top air flow paths.

In some embodiments, the first isolator 2 has a ceramic body structure. Wherein, the structure body of the ceramic material has good heat-insulating and flame-retardant effects, and raw materials are widely sourced with low cost, so that the costs can be effectively reduced. Of course, in other embodiments, the first isolator 2 may be other heat-insulating and flame-retardant materials, which are not particularly limited herein.

In some embodiments, the first isolator 2 has a cylindrical structure, a peripheral wall of the first isolator 2 protrudes outwardly to form a convex arc structure, and the radial length of the first isolator 2 adjacent to the cigarette pipe 1 is greater than the radial length of the first isolator adjacent to the mouthpiece 3. Wherein, the convex arc of the circular drum shape at the peripheral wall of the first isolator 2 facilitates the gripping of the first isolator 2 inside the cigarette pipe 1, thus, the assembly process is simpler and easier, and the radial length of the first isolator 2 adjacent to the cigarette pipe 1 is greater than the radial length adjacent to the mouthpiece 3, so that the airflow formed by burning the tobacco can be better concentrated in the mouth at the end of the mouthpiece 3, further improving the experience during smoking.

Figure 2:
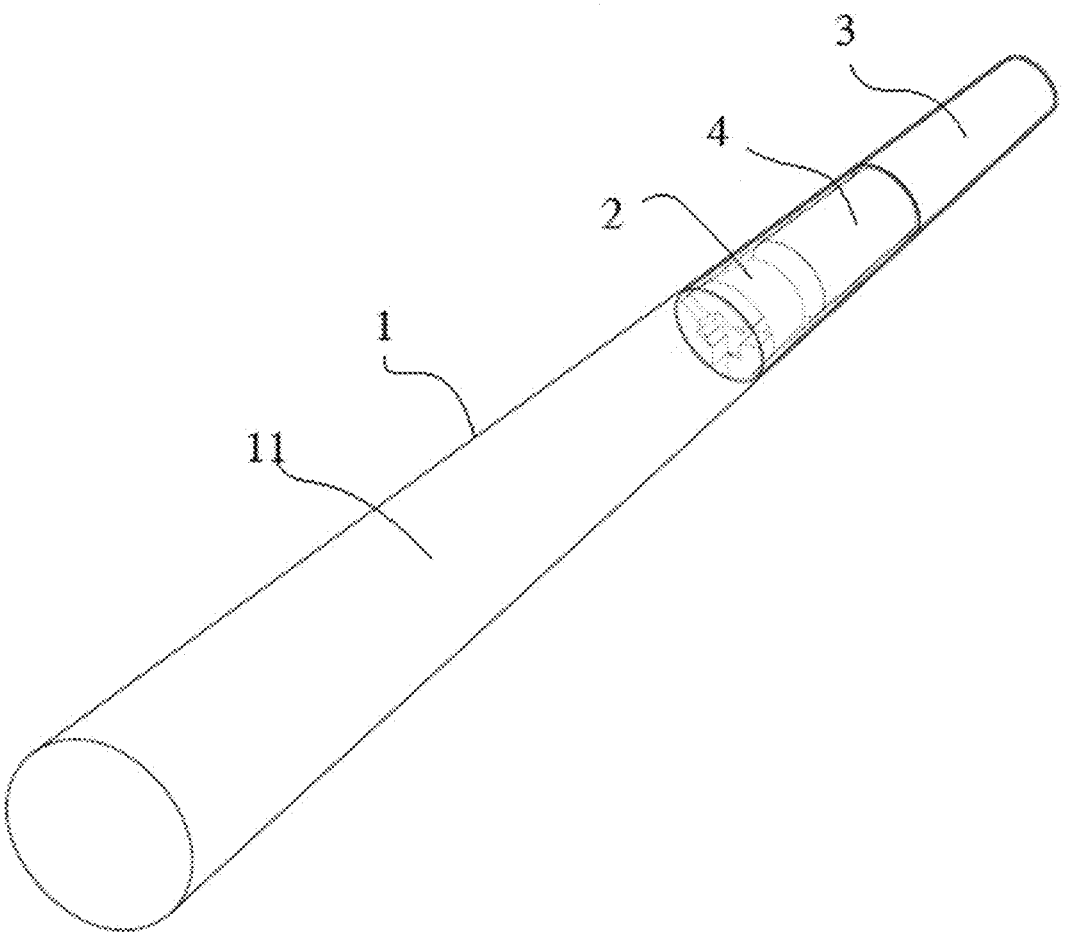
FIG. 2 is a schematic structural diagram of a cigarette device according to another embodiment of the present disclosure.

In some embodiments, as shown in FIGS. 1 and 2, the cigarette device as a whole has an approximately conical tube structure, and the radial length of the end of the mouthpiece 3 is less than the radial length of the end of the cigarette pipe 1.

Figure 5:
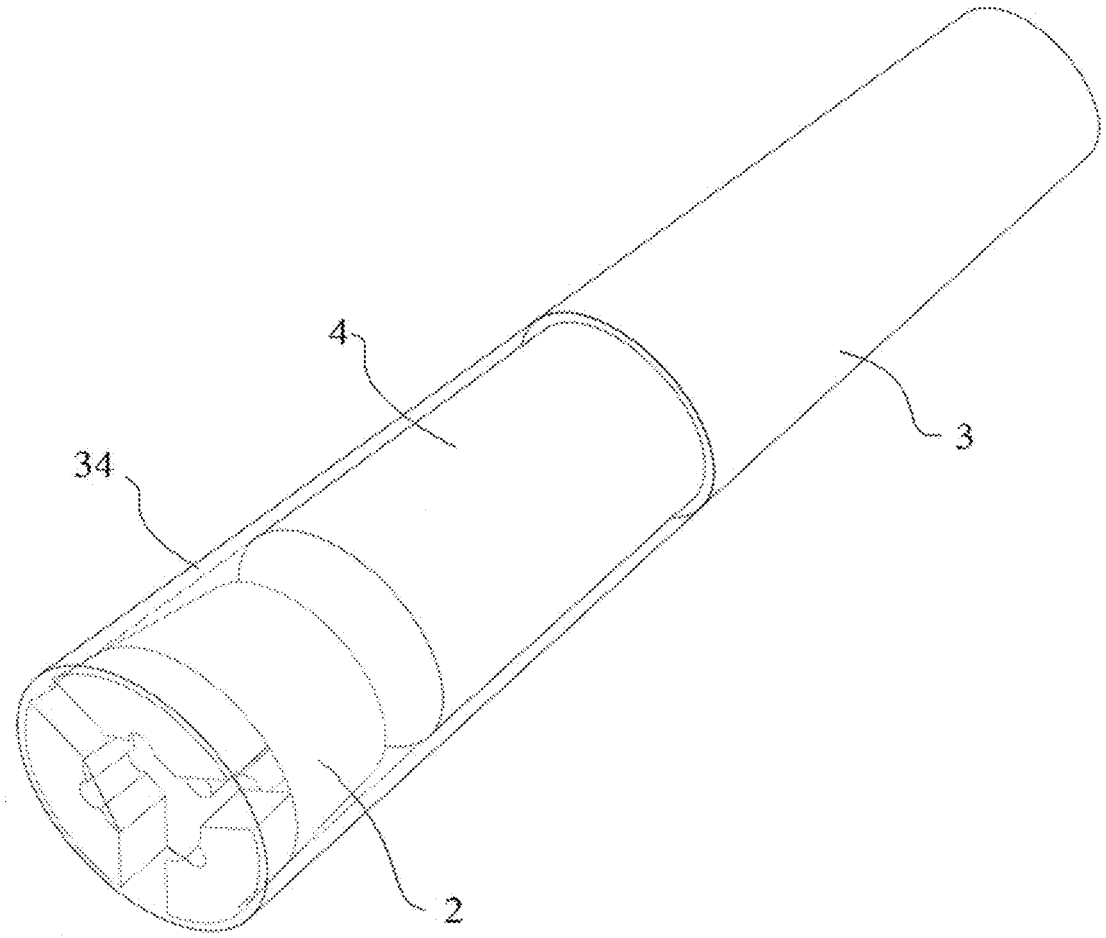
FIG. 5 is a schematic diagram of a partial structure of the cigarette device of FIG. 2.
Figure 7:
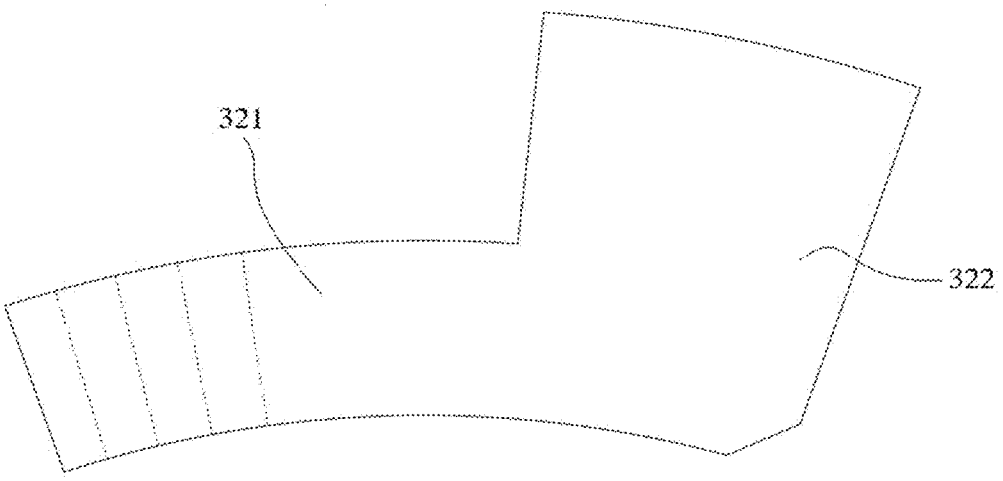
FIG. 7 is a schematic structural diagram of a mouthpiece in an unfolded state according to another embodiment of the present disclosure.
Figure 10:
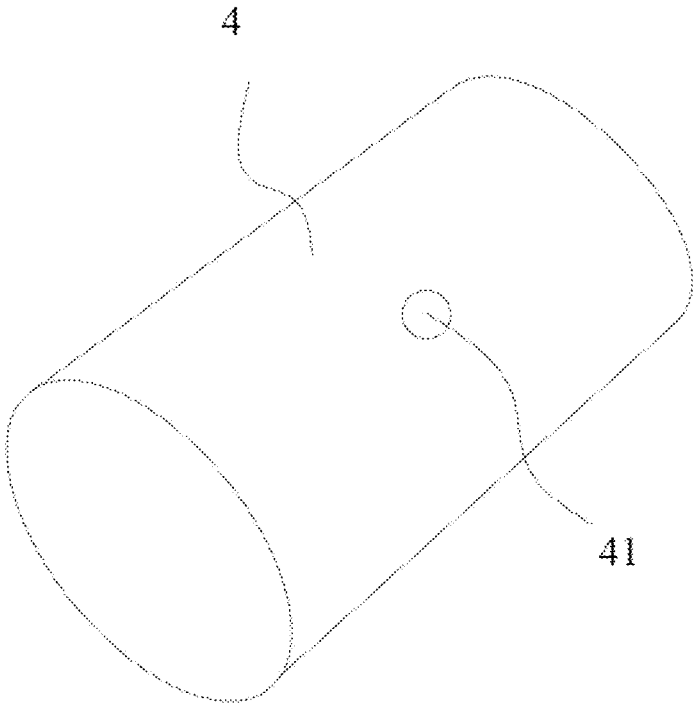
FIG. 10 is a structural diagram of a second isolator according to an embodiment of the present disclosure.

In some embodiments, as shown in FIGS. 2, 5 and 10, the cigarette device further includes a second isolator 4 having an adsorbing property, the second isolator 4 being disposed between the mouthpiece 3 and the first isolator 2. Wherein, as shown in FIGS. 7 and 9, when the cigarette device further includes a second isolator 4, the height of the second rolling body 322 of the rolling body 32 can be substantially increased to adjust the depth of the peripheral edge 34 of the rolled mouthpiece 3, wherein the second isolator 4 can be fully accommodated within the peripheral edge 34, and at least a portion of the structure of the first isolator 2 can also be accommodated within the peripheral edge 34. The second isolator 4 can be flame-retardant, heat-resistant and oil-absorbing cotton, which is capable of adsorbing harmful substances, and has a flame-retardant heat-resistant effect, further improving the smoking experience.

In some embodiments, a flavoring member is disposed in the second isolator 4 and a flavoring material is provided in the flavoring member. In particular, a mounting hole 41 may be provided in the second isolator 4, in which the flavoring member with the flavoring material is placed, wherein the flavoring material can be a flavoring material which can provide different flavors, such as cigarette popping beads or fragrance retention granules, so as to provide taste selection and provide a richer smoking experience. It should be noted that in other embodiments, the cigarette device may be provided with only the first isolator 2 and the flavoring material is placed in the first isolator 2, wherein the flavoring material of the flavoring member may be fragrance retention granules or the like, and there is no need to arrange the second isolator 4 for placing the flavoring member.

In summary, the cigarette device can provide a DIY form of the hand cigarette pipe 1, the mouthpiece 3 and integral packaging of the tobacco on the basis of fully respecting the user's usage habits, thereby improving the smoking experience.

The above embodiments are also not an exhaustive enumeration based on the present disclosure, in addition to which there may be a plurality of other embodiments that are not listed. Any substitutions and improvements made on the basis that do not violate the ideas of the present disclosure are within the scope of protection of the present disclosure.

What is claimed is:

1. A cigarette device, comprising a cigarette pipe, a first isolator and a mouthpiece which are arranged in sequence;

the cigarette pipe is rolled to form a hollow accommodating space inside, and the accommodating space is used for accommodating a smoking substance;

the mouthpiece is provided with a first diversion channel; and the first isolator separates the mouthpiece from the smoking substance, and the first isolator is provided with a second diversion channel, the second diversion channel communicates the first diversion channel with the accommodating space of the cigarette pipe, wherein the mouthpiece is provided with a peripheral edge near an end of the cigarette pipe, the peripheral edge forms a receiving groove, the first isolator is partially or wholly accommodated in the receiving groove, and the cigarette pipe sleeves a portion or all of an outer peripheral wall of the mouthpiece, wherein the mouthpiece comprises a rolling body that is flexible, the rolling body is rolled and/or folded to form a multi-layer roll-shaped mouthpiece, a spacing space exists between at least two adjacent layers in the mouthpiece that is roll-shaped, and the spacing space forms the first diversion channel, wherein the rolling body comprises a first rolling body and a second rolling body connected with the first rolling body, after the rolling body is rolled and/or folded, the second rolling body encloses a periphery of a roll-shaped layer of the first rolling body and partially protrudes from the roll-shaped layer of the first rolling body, and a portion of the second rolling body protruding from the roll-shaped layer of the first rolling body forms the peripheral edge, wherein the first isolator is fixed by the peripheral edge, and the first rolling body and the second rolling body are one piece of material, wherein the portion of the second rolling body protruding from the first rolling body is located between the first rolling body and the cigarette pipe and protrudes along a central axis of the cigarette pipe, and wherein the second diversion channel comprises a plurality of air flow holes formed in an axial direction of the first isolator, the first isolator is inwardly recessed at one end adjacent to the cigarette pipe to form a groove communicating with the air flow holes, and the groove extends outward in its own radial direction to form radial air passages, and the radial air passages are located on a surface that faces the cigarette pipe.

2. The cigarette device according to claim 1, wherein a longitudinal cross-section of the mouthpiece has a roll-shaped structure with an inner layer in an M-shape and an outer layer in a spiral shape.

3. The cigarette device according to claim 1, wherein a longitudinal cross-section of the mouthpiece has a spiral roll-shaped structure.

4. The cigarette device according to claim 1, wherein the first isolator has a cylindrical ceramic body structure.

5. The cigarette device according to claim 4, wherein a peripheral wall of the first isolator protrudes outwardly to form a convex arc structure, and a radial length of the first isolator adjacent to the cigarette pipe is greater than the radial length of the first isolator adjacent to the mouthpiece.

6. The cigarette device according to claim 1, wherein a flavoring member is disposed in the first isolator, and a flavoring material is provided in the flavoring member.

7. The cigarette device according to claim 1, wherein the cigarette device further comprises a second isolator, the second isolator being absorbing, the second isolator being disposed between the mouthpiece and the first isolator.

8. The cigarette device according to claim 7, wherein a flavoring member is disposed in the second isolator, and a flavoring material is provided in the flavoring member.

* * * * *